United States Patent [19]

Magnien et al.

[11] Patent Number: 4,866,823

[45] Date of Patent: Sep. 19, 1989

[54] PROCESSES AND DEVICES FOR MECHANICALLY SETTING A PLURALITY OF SMALL PRECIOUS STONES ON A FLAT FACE OF A JEWEL

[75] Inventors: Emile G. Magnien; Alain M. Plantureux, both of Montpellier, France

[73] Assignee: Diamant Applications, La Zolad, France

[21] Appl. No.: 225,060

[22] Filed: Jul. 27, 1988

[30] Foreign Application Priority Data

Aug. 14, 1987 [FR] France ..... 87 11662

[51] Int. Cl.[4] ..... B23P 5/00

[52] U.S. Cl. ..... 29/10; 29/513; 29/160.6

[58] Field of Search ..... 29/160.6, 10, 513; 63/26, 27, 28

[56] References Cited

U.S. PATENT DOCUMENTS

| | | | |
|---|---|---|---|
| 2,602,986 | 7/1952 | Centini et al. | 29/10 |
| 2,858,597 | 11/1958 | Kraemer et al. | 29/10 |
| 3,099,068 | 7/1963 | Kortick | 29/10 |
| 3,634,917 | 1/1972 | Kortick | 29/10 |

FOREIGN PATENT DOCUMENTS

| | | | |
|---|---|---|---|
| 3342021 | 5/1985 | Fed. Rep. of Germany | 63/26 |
| 1066702 | 1/1984 | U.S.S.R. | 29/160.6 |
| 2179236 | 3/1987 | United Kingdom | 63/26 |

*Primary Examiner*—P. W. Echols

*Attorney, Agent, or Firm*—Lester Horwitz

[57] ABSTRACT

This invention relates to a device for mechanically setting a plurality of small precious stones in a jewel setting having a flat face, which device comprises an upwardly open dish element fixed on a horizontal table, a cover which fits with a very small clearance in the dish element and is centered therein, tools for driving in and setting the stones which are fixed beneath the cover and a jewel setting support which is fixed in the bottom of the dish element.

17 Claims, 5 Drawing Sheets

PROCESSES AND DEVICES FOR MECHANICALLY SETTING A PLURALITY OF SMALL PRECIOUS STONES ON A FLAT FACE OF A JEWEL

FIELD OF THE INVENTION

The present invention relates to processes and devices for mechanically setting a plurality of small precious stones on a flat face of a jewel.

The technical sector of the invention is that of the mechanized manufacture of jewels set with small precious or semi-precious stones, particularly small diamonds cut as brilliants.

BACKGROUND OF THE INVENTION

Jewels (necklaces, bracelets, brooches, pendants, watches, etc. . . .) are already known, comprising flat faces which are set with a large number of small precious or semi-precious stones placed side by side. These stones are generally very small, their largest dimension possibly being less than 1 mm. The stones are placed in housings which are machined in the mass of the metal constituting the setting of the jewel, then they are set by means of claws constituted by collets of metal surrounding each stone.

Up to the present time, by using numerical control machines which allow relative displacements along five axes of the tool with respect to the piece to be machined, it is known to machine in series the metal setting, forming therein housings adapted to receive the stones and leaving collets of metal adapted to serve as claws for setting the stones, with the necessary high precision of machining.

Such processes of machining are disclosed in Patent Nos. FR-A-2 579 085, FR-A-2 580 155 and FR-A-2 593 039 to DIAMANT APPLICATIONS.

Once the setting is machined on a machine tool, each stone must be positioned in a housing and the stones must be set.

These operations may be carried out manually under a binocular magnifier but, taking into account the very small dimensions of the stones and the large number thereof, manual operations are expensive.

In the case of brilliants or other stones which are cut to a point and of which the visible face is a flat table which must be parallel to the flat face of the setting, a difficulty lies in the fact that stones of the same granulometry do not have the same height between the sides of the pavilion which abut on a seat machined in the setting and the table of the stone and, in the same class of granulometry, differences in height of the order of one tenth of the diameter of the stone are frequently encountered.

These differences in height create problems when it is desired to set, mechanically and simultaneously, a plurality of stones on a flat face. In that case, the setting set with stones is placed between the plates of a press so that the flat face is parallel to these plates and the claws are pressed so that they themselves abut on the stones, but in that case there is a risk of shattering the uppermost stones which do not resist the shear and compression forces.

Patent Nos. FR-A-2 580 155 and FR-A-2 593 039 to DIAMANT APPLICATIONS describe machining processes for making deformable seats and for placing the tables of all the stones in the same plane parallel to the plane face of the setting receiving the stones. These two documents also describe a process of mechanical setting by means of plates which come into abutment on the tables of all the stones in order to take them to the same level and on the claws in order to deform them and set the stones.

It is an object of the present invention to provide a particular device for mechanically and simultaneously setting a plurality of stones on a flat face of a jewel setting, by using a press and a process and device for simultaneously positioning all the stones in their housing, mechanically, by using this device.

SUMMARY OF THE INVENTION

The object of the invention is attained by means of a device which comprises:

an upwardly open dish element adapted to be placed on the lower plate of a press;

a cover which fits with a very small clearance in said dish element, being centered therein and which comprises, on its lower face, means for fixing tools;

a setting support which is positioned in the bottom of said dish element by positioning catches and which comprises means for fixing a jewel setting, in a position well determined with respect to said support and such that said flat face which is to be set with stones is horizontal, directed upwardly and freely accessible;

and tools for driving in the stones and for setting the claws which are fixed beneath said cover.

According to a preferred embodiment, the support of the jewel setting comprises a base whose flat lower face comes into abutment against the horizontal bottom of said dish element and comprises bores in which penetrate positioning catches located in the bottom of the dish element.

The cover advantageously comprises, on its lower face, a flange which penetrates in said dish element which is cylindrical, which flange has an outer face whose diameter presents a very small tolerance with respect to the diameter of said dish element.

A device according to the invention, adapted to position the stones, mechanically and simultaneously, in their housing, further comprises a vibrating bowl which is used in combination with a stone transfer tool fixed inside the flange of said plate in order mechanically to position the stones in the housings machined in said jewel setting.

Said vibrating bowl comprises a body which defines a closed central cavity which is connected to a suction apparatus and it comprises, on its upper face, a dish whose bottom descends towards the periphery from a central summit and housings each adapted to receive a stone, which are disposed on the periphery of the bottom of said dish and which communicate with said central cavity and the arrangement of said housings reproduces the arrangement on the setting of the housings adapted to receive said stones.

According to a preferred embodiment, the transfer tool defines an upwardly open cavity and comprises a ring which may penetrate in said dish and which is traversed by small bores which communicate with said cavity and said cover comprises a conduit which opens out in an axial bore open at its lower end, which conduit is adapted to be connected on a suction apparatus to place the cavity of said transfer tool under reduced pressure when the latter is fixed to said cover.

The tools for driving in the stones comprise, on their lower face, a rib, for example a ring which abuts on the tables of the stones and which place the latter in the same plane parallel to said flat face of the setting when the cover is pressed by a press.

Said rib advantageously comprises, on its lower face, recesses which are disposed above the claws for setting the stones.

The setting tools comprise on their lower face a setting rib which comes into abutment on the tops of the setting claws in order to deform them permanently when the cover is pressed with a stone.

The lower face of the setting rib advantageously comprises recesses which cover the tables of the stones and which avoid said setting ring abutting on the stones during setting of the claws.

The lower face of the setting rib comprises concave notches which are positioned above the setting claws and which abut on the heads thereof.

A process according to the invention for mechanically setting a plurality of precious stones in a flat face of a metallic jewel setting, comprises the following operations of:

machining in said setting housings adapted to receive stones by means of a numerical control machine, so that these housings present a deformable seat;

fixing said setting on a setting support which maintains it in a determined position;

placing said support in a well determined position in the bottom of a dish element which is placed on the lower plate of a press;

depositing a stone in each housing;

fixing on a cover a tool for driving the stones in their housing;

engaging said cover in said dish element, guiding it so that it remains well centered and pressing on said cover with the second plate of a press until it comes into abutment against the upper face of said dish element and, at that moment, the tables of all the stones lie in the same determined plane parallel to said flat face of the setting;

then fixing on a cover a tool for setting the claws, engaging said plate again in said dish element and pressing again on said cover with the second plate of the press until it comes into abutment again against the upper face of said dish element and, at that moment, the claws are set uniformly on said stones.

The stones are advantageously positioned simultaneously in their housing by mechanical means, by a process comprising the following operations: firstly pouring said stones into the dish of a vibrating suction bowl which distributes them mechanically in housings, placed in the bottom of said dish, which reproduce the arrangement of the housings machined in said setting, said dish is then turned over on a transfer tool which is placed under reduced pressure and which comprises bores on each of which a stone adheres and said transfer tool is then placed in said dish above said setting, then the reduced pressure is eliminated so that each stone is engaged in one of said housings.

The invention results in the mechanized manufacture of jewels comprising flat faces on which a plurality of precious or semi-precious stones are set.

The devices according to the invention make it possible mechanically to carry out the operations of setting the claws by means of a press, after having previously driven the stones in their housing, to bring the tables of all the stones in the same plane so that there is no risk of breaking certain stones during the mechanical setting.

The devices according to the invention also enable all the stones to be positioned mechanically and simultaneously on a flat face of a jewel by suction by means of a vibrating bowl and a transfer tool which matches the cover of a device according to the invention.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
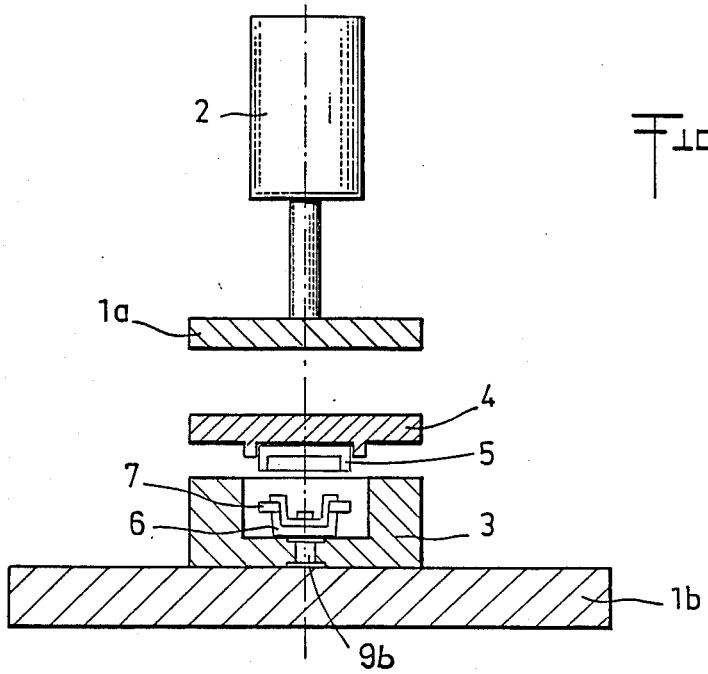
FIG. 1 is a vertical section of the whole of a device according to the invention.

FIG. 1 schematically shows an exploded vertical section of a device according to the invention.

References 1*a* and 1*b* represent the upper plate and the lower plate of a press, which are mobile with respect to each other by a jack 2 or by any other means. The plates are horizontal and the mobile plate is displaced vertically.

In a variant, reference 1*a* may represent a horizontal table and reference 1*b* the head of a vertical jack.

Reference 3 represents a metal dish element which is placed on the lower plate 1*b*.

Reference 4 represents the dish cover 4 which is placed on the dish element 3 and which is centered with respect thereto.

Reference 5 represents one of the tools which may be fixed on the lower face of the cover 4.

Reference 6 represents a jewel setting support which is placed in the bottom of the dish element 3 and which serves to hold a jewel setting 7 in a determined position, presenting a flat face of this setting upwardly, which face has already been machined and comprises housings adapted to receive precious stones.

Figure 2:
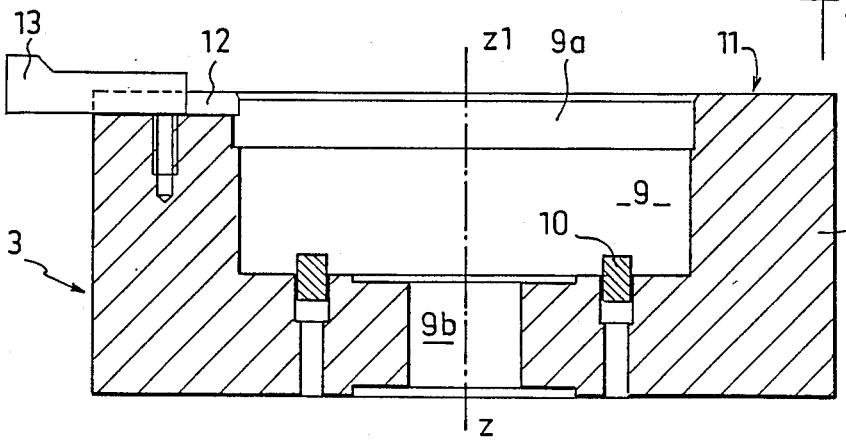
FIG. 2 is an axial section through a dish element.

FIG. 2 is an axial vertical section through a preferred embodiment of the dish element 3.

The dish element 3 is composed of a metal body 8 which defines an upwardly open cavity 9 having for example a vertical cylindrical form of axis z-z1. The bore 9 is surmounted by a counter-bore 9*a* which is machined with very high precision. The bottom of the cavity comprises bores in which are placed projecting catches 10 adapted to center the setting support 6.

The upper face 11 is machined with precision to serve as support face for the cover 4 which will come into abutment against this face. The body 8 comprises a mortise 12 which cooperates with a mortise 12*a* hollowed out in the wall of the cover to receive a pin 13, which renders dish element 3 and cover 4 fast in rotation, whilst allowing a relative axial displacement. The body 8 comprises an axial bore 9*b* which opens out in the bottom of the dish element.

Figure 3:
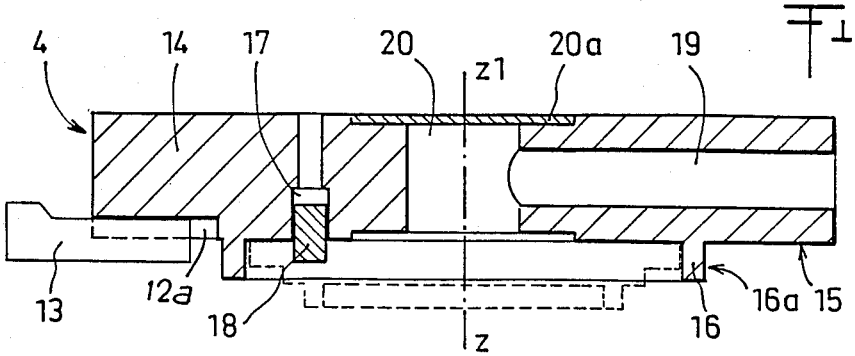
FIG. 3 is an axial section through a dish cover.

FIG. 3 is an axial section through the cover 4 of the dish element. Said cover comprises a metal body 14 whose lower face 15 is machined with precision and comes into abutment on the upper face 11 of the dish element 3. It comprises a cylindrical flange 16 in relief with respect to the lower face 15. The outer face 16*a* of the flange is machined with very high precision to fit in the counterbore 9*a*, so that, after fitting, axes z-z1 of the dish element and of the cover merge.

The body 14 comprises bores 17 which open out on its lower face inside the flange 16, in which are placed projecting catches 18 adapted for centering the tools 5 which are mounted in the flange 16.

The body 14 comprises a horizontal bore 19 which opens out in a central bore 20. The bore 19 may be connected to a suction means in order to be placed under reduced pressure.

Figure 4:
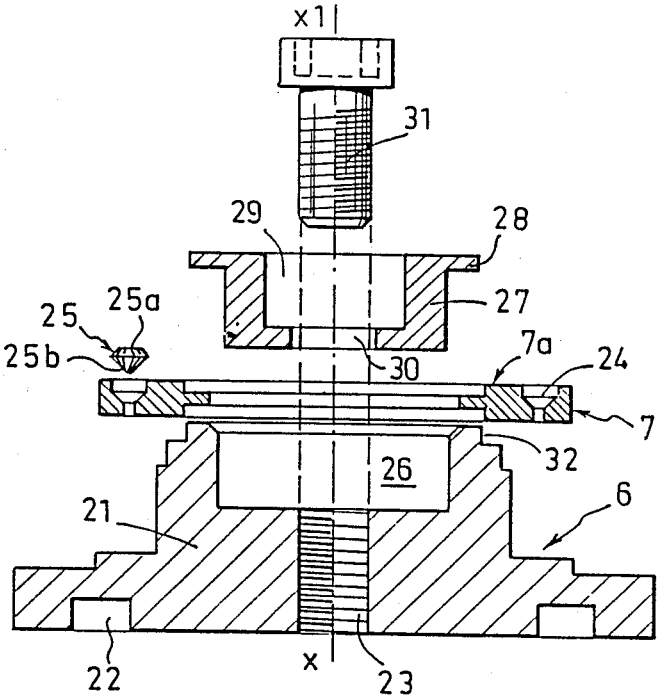
FIG. 4 is an exploded view of a jewel setting support.

FIG. 4 is an exploded view of an axial section of an embodiment of a setting support 6 adapted to be placed in cavity 9 of dish element 3.

The support comprises a base 21 which comprises on its lower face blind bores 22 adapted to receive the catches 10 located in the bottom of the dish element, with the result that the base 21 is centered in the dish element. It comprises a central bore 23 which is threaded.

FIG. 4 represents an example in which the jewel setting 7 is a watch bezel, i.e. a frame which surrounds the dial of a watch, which frame presents a flat upper face 7*a*.

Before placing this setting on its support, it was machined to prepare over the whole of its periphery or over part thereof, housings 24 adapted each to receive a small diamond 25 cut as a brilliant, having a pavilion 25*b* adapted to penetrate in housing 24 and a flat table 25*a* which constitutes the visible upper face.

The body 21 comprises an axial counterbore 26 in which is housed a cover 27 which comprises a peripheral flange 28. The cover 27 comprises an axial dish 29 whose bottom extends in an axial bore 30.

The setting support 6 further comprises a fixing bolt 31 whose head is housed in the dish 29.

After having placed the bezel 7 or any other jewel setting on the top of the base 21, the cover 27 is placed in the bore 26 so that the flange 28 comes into abutment against part of the setting 7 which is gripped between the base 21 and the cover 27. The bolt 31 is then screwed in the threaded bore 23.

FIG. 4 represents an embodiment of a support of a setting 7 which is circular and which is placed against a circular peripheral shoulder 32 which centers it with respect to support 21. Of course, the shape of the base 21 and of the cover vary depending on the shape of the jewel setting, but in any case, these pieces are designed to maintain the setting 7 in a well determined position, in which a flat face 7*a* of the setting, which is already machined to receive stones, is placed in horizontal position, at a well determined level with respect to the lower face of the body 21 and is freely accessible from above.

Once setting 7 is gripped between the base 21 and the cover 27, support 6 may be placed inside dish element 3 by engaging the centering catches 10 in the blind bores 22, with the result that support 6 and setting 7 occupy a precise position with respect to the dish element According to a first variant, there is manually placed in each housing 24 in the setting, a brilliant 25 whose point is directed downwardly. This operation may be carried out before placing the support 6 in the dish element 3, or after having placed it in position in the dish element.

According to another characteristic process of the present invention, a device may be used for mechanically positioning the brilliants 25 in the housings 24.

Figure 5:
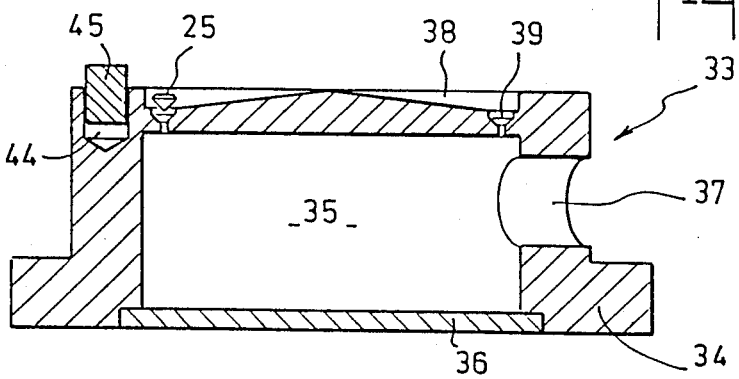
FIG. 5 is an axial section through a vibrating bowl.

In that case, a so-called vibrating bowl is used, which is shown in axial section in FIG. 5.

The vibrating bowl 33 comprises a body 34 which defines an axial cavity 35, which is hermetically obturated by a plate 36. The cavity 35 communicates with a lateral bore 37 which may be connected to a suction apparatus in order to place cavity 35 under reduced pressure, for example of the order of 10000 Pascals (100 mbars).

The upper face of the bowl 33 comprises a dish 38 whose bottom slopes down slightly towards the periphery from a central summit.

Bores 39 which communicate with cavity 35 are machined in the bottom of the dish 38. The arrangement of these bores reproduces exactly the arrangement of the housings 24 machined in the settings 7. Bores 39 and housings 24 are advantageously machined on the same numerical-control machine tool using the same machining program. Bores 39 advantageously comprise, like housings 24, two cylindrical bores placed on either side of a truncated seat.

Bores 39 are disposed near the lateral wall of dish 38.

The bowl 33 is placed on a vibrating table, the brilliants 25 are poured into the dish 38, tube 37 is connected by means of a flexible pipe onto a suction apparatus and the brilliants are automatically distributed all around the periphery of the dish 38 and they are sucked by the reduced pressure towards bores 39, in which they are positioned.

It is checked under a binocular magnifier that all the bores 39 are filled and that the brilliants are disposed with their point facing downwards. Their position is corrected by hand if necessary.

Figure 6:
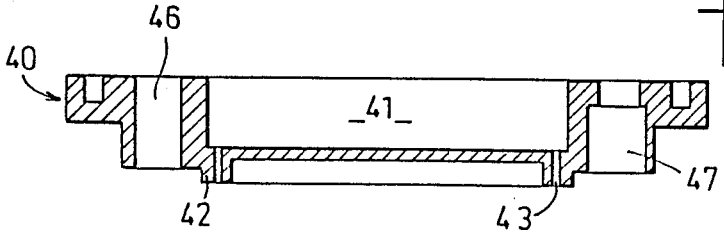
FIG. 6 is an axial section through a transfer tool employing suction.

FIG. 6 represents an axial section of a first tool 5, i.e., a tool 40 which is adapted to be fixed beneath cover 4 within the cylindrical flange 16, as shown in phantom in FIG. 3. The tool 40 has a circular shape, when viewed along the axis Z-Z1 of FIG. 3.

FIG. 6 shows two axial half-sections of the tool 40 along two planes perpendicular to each other, i.e., the sections are taken along two radii at right angles to one another. Thus, while two bores 46 and 47 through the tool 40 are shown in FIG. 6, the two bores are actually disposed 90° apart around the circumference of the tool. The tool 40 is used in combination with the vibrating bowl 33 for mechanically transferring the brilliants 25 to the housings 24 of a jewel setting 7, held by the support 6 in the dish element 3.

The body of the transfer tool 40 defines an axial cavity 41. The lower face of the tool 40 bears a ring 42 whose dimensions correspond to those of the circle on which are located the bores 39 of the vibrating bowl. Bores 43, which open out into cavity 41 are pierced through ring 42. The distribution of the bores 43 on the ring 42 corresponds to the distribution of the bores 39.

The body 34 of the vibrating bowl 33 comprises, on its upper face, blind bores 44 in which are placed positioning catches 45. The body of the transfer tool 40 comprises bores 46.

The tool 40 also comprises bores 47 adapted to receive bolts 47*a* which make it possible to fix it on the face 15 of the plate 4, inside the ring 16.

The catches 18 for positioning the cover 4 are engaged in the bores 46 in order to position the tool 40 with respect to the cover.

In this application, the upper end of the axial bore 20 of the cover is hermetically obturated by a plate 20*a*.

Figure 7:
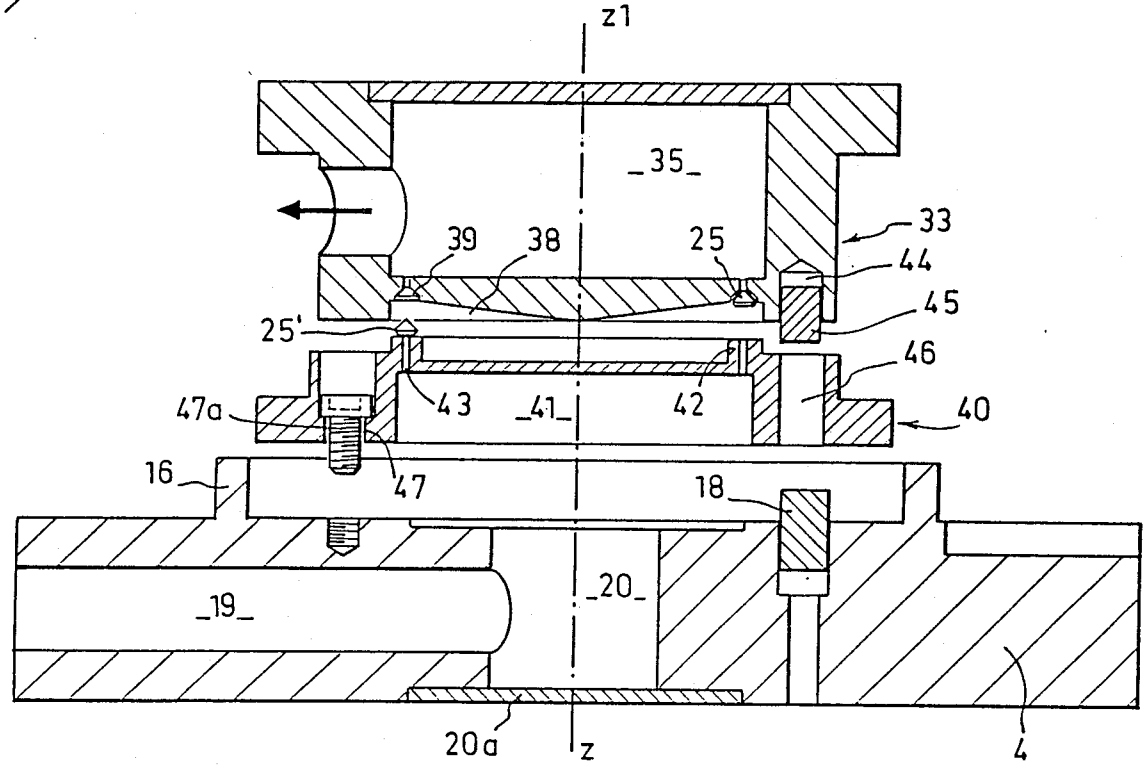
FIG. 7 is an exploded view in section showing the relative positions of the cover, of the transfer tool and of the vibrating bowl during transfer of the stones.

FIG. 7 shows, in exploded view, the relative position of the cover 4, the bowl 33 and the transfer tool 40 during the transfer operation which is described hereinafter.

Cover 4 is placed in upturned position and the transfer tool 40 is fixed inside the flange 16 by bolts 47*a*. The positioning catches 18 center the transfer tool with respect to the cover.

In a preceding step, brilliants 25 had been placed in housings 38 in the vibrating bowl 33 of which the dish 39 faced upwardly.

Suction is maintained in the bowl 35 and it is turned over above the transfer tool 40 so as to engage the catches 45 in the bores 46 in order to center the bowl.

The dimensions of the bowl and of the ring 42 are such that, when the bowl is in abutment on the transfer tool 40, the upper face of the ring 42 is placed at a very short distance from the table of the stones 25, maintained applied against the bowl by the suction. Suction is then cut off in the bowl 35 and the suction connected to conduit 19 is actuated so that the cavity 41 is placed under reduced pressure and the brilliants are sucked against conduits 43 and occupy a position such as brilliant 25' shown in the left-hand part of FIG. 7.

The bowl 33 is then removed and the cover 4 to which the transfer tool 40 is fixed is turned over, whilst maintaining suction in conduit 19; after which the cover 4 is placed on the dish element 3 in which it is engaged and centered, so that each brilliant 25' engages by its point in one of the housings 24 machined in the setting 7. Suction in conduit 19 is then cut off and the cover 4 bearing the transfer tool 40 is removed.

Figure 8:
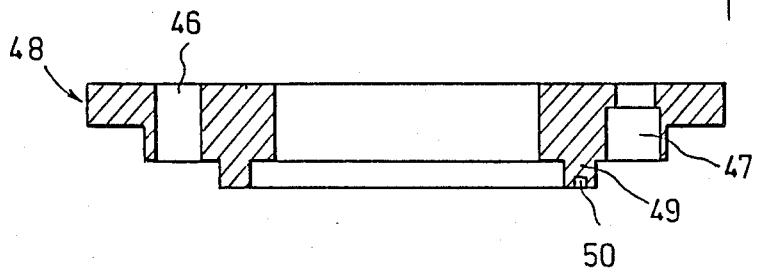
FIG. 8 is a section through a tool for driving in stones.

FIG. 8 shows two half-sections at 90° of a second tool 48 which is adapted to be fixed on a cover 4 to drive the brilliants into their housings until the tables 25*a* of all the brilliants are in the same plane parallel to the upper flat face of the setting.

Tool 48, like transfer tool 40, is fixed in position 5 of FIG. 1 and the fixing and positioning means are the same as those of tool 40 and are represented by the same references.

The driving tool 48 comprises a ring 49 which has substantially the same diameter and the same width as the ring 42 but which has a greater height, for example 2 mm, against 1.4 mm for ring 42.

The driving tool 48 is fixed on a cover 4 and the latter is fitted in the dish element 3.

The height of the ring 49 is machined with high precision, of the order of 0.01 mm with respect to the upper face of the tool 48 which is applied against the lower face of the cover 4. When the cover bearing the driving tool 48 is fitted on the dish element in which is placed a jewel setting 7 which is set with brilliants 25 placed in their housing, the lower face of the ring 49 comes into abutment on the tables of the uppermost stones. Plate 1*a* is then descended and it abuts on the cover 4 until the lower face 15 thereof comes into abutment against the upper face 11 of the dish element 3. At that moment, the lower face of the ring 49 is applied against the tables of all the brilliants which are therefore all in the same plane parallel to face 11 and located at a well determined distance therefrom. By a determined tooling, this distance may be varied either by placing shims between the bearing faces 11 and 15, which makes it possible to reduce the penetration of the brilliants, or by placing shims beneath the base 6 of the setting support, which has for its effect to increase penetration of the brilliants in the setting.

The arrangement of the tables of all the stones in the same plane is very important for the quality of setting and for the surface appearance of the jewel. It is obtained due to the fact that the seats on which the brilliants 25 abut are deformable and the efforts to be exerted to deform them and which are transmitted by the stones themselves, are less than the resistance to shear and to compression of the stones which do not risk breaking under the effect of the thrust exerted by the press.

The brilliants are set in housings 24 which are surrounded by collets of metal intended to serve as claws and which therefore forcibly project above the tables of the brilliants. In order to avoid crushing these collets, the ring 49 of the driving tool comprises recesses 50 which are disposed so that they cover the claws during the driving-in operation.

Figure 9:
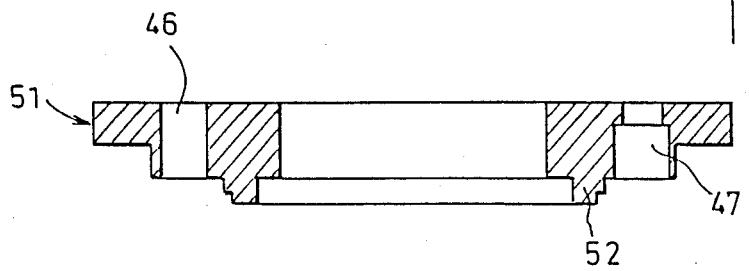
FIG. 9 is a section through a setting tool.

FIG. 9 shows two half-sections at 90° of a third tool 51 which is fixed in position 5 on the cover 4 and which is adapted to set the claws.

This tool comprises fixing and positioning means identical to those of tools 40 and 48 which are designated by the same references.

It comprises, on its lower face, a ring 52 whose lower face serves as tool for setting the claws.

Figure 10:
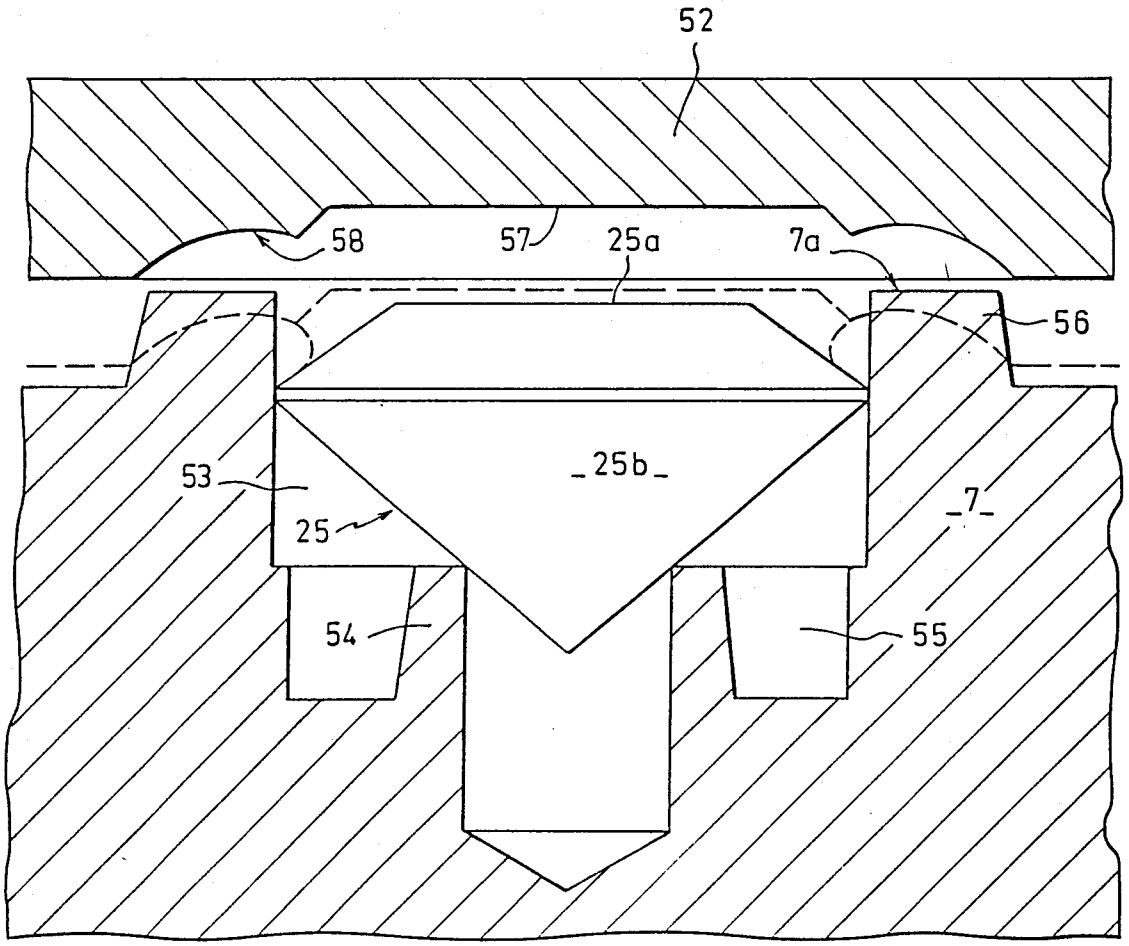
FIG. 10 is a partial section on a larger scale of a brilliant in the course of being set.

FIG. 10 is a view on a larger scale of a brilliant 25 placed in a housing 53 hollowed in a setting 7. This housing comprises a seat 54, on which abuts the pavilion 25*b* of the brilliant 25. This seat is deformable. For example, it is separated from the body of the setting by a groove 55 which allows it to bend.

FIG. 10 shows a brilliant in the position that it occupies after having been driven in by means of the driving tool 48. The table 25*a* lies in the same plane as the table of all the other brilliants and this plane lies at a level lower than the outer face 7*a* of the setting, which is the plane of the top of the claws 56.

FIG. 10 shows a section of the setting ring 52. This latter comprises on its lower face recesses 57 in the form of an upturned dish which cover and reach beyond the upper part of the brilliant, so that, at the end of setting where the ring occupies the position shown in dotted lines, it does not come into contact with the stones.

The lower face of the setting ring further comprises concave notches 58 which abut on the top of the claws 56 and which deform them by bending them down on the edges of the brilliants in order to set the latter in their housing.

FIG. 10 shows a preferred embodiment of the notches 58 whose depth increases from the periphery towards the axis of each brilliant. Such notches are obtained by machining the ring with a ball milling cutter which is displaced obliquely with respect to the outer face of the ring, i.e. which is displaced radially from the periphery towards the axis of the housing 53, causing it to penetrate more and more deeply.

Setting of the stones is obtained by fixing a setting tool 51 beneath the cover 4, inside the flange 16, engaging the flange 16 in the dish element 3 and pressing on the cover 4 by means of the press plate 1*a* or a jack until the lower face 15 of the cover 4 comes into contact with the bearing face 11 of the dish element.

As the tables of all the stones were previously placed at the same level during the preceding operation of driving in the stones, all the claws abut on the stones in the same way and the relative position of the setting ring with respect to the reference plane in which the tables of the stones lie may therefore be adjusted in order to obtain a permanent deformation thereof by mechanical means, without risking breaking certain stones higher than the others.

The foregoing description describes an example relative to a watch bezel on which the stones are disposed in a circle and, in that case, the tools for driving, setting and suction of the stones comprise a circular ring. It is specified that this example is not limiting.

A process according to the invention makes it possible to set stones on flat faces of jewel settings of any shape whatsoever and, of course, in each case, the driving, setting and suction tools comprise a projecting rib on their lower face which follows the shape of the flat face of the setting on which the jewels are to be set.

What is claimed is:

1. A device for mechanically setting a plurality of precious stones in a jewel setting having a flat face, comprising:

an upwardly open dish element adapted to be placed on the lower plate of a press or on a horizontal table;

a first cover which fits with a very small clearance in said dish element, being centered therein and which comprises, on its lower face, means for fixing tools;

a setting support which is positioned in the bottom of said dish element by positioning catches and which comprises means for fixing a jewel setting, in a position well determined with respect to said support and such that said flat face which is to be set with stones is horizontal, directed upwardly and freely accessible;

and tools for driving in the stones and for setting the claws which are fixed beneath said cover.

2. The device of claim 1, wherein said setting support comprises a base whose flat lower face comes into abutment against the horizontal bottom of said dish element and comprises bores in which penetrate positioning catches located in the bottom of said dish element.

3. The device of claim 2, wherein said setting support comprises a threaded axial bore surmounted by a counterbore and comprises a second cover and a bolt for fixing said second cover in said counterbore and said jewel setting is gripped between said base and said second cover.

4. The device of claim 1, wherein said first cover comprises, on its lower face, a flange which penetrates in said dish element which is cylindrical, which flange has an outer face which is machined with a diameter which presents a very small tolerance with respect to the inner diameter of said dish element.

5. The device of claim 4, wherein said tools for driving in the stones and said tools for setting the claws have similar shapes and are fixed against the lower face of said cover inside said flange and are positioned with respect to said cover by positioning catches.

6. The device of claim 5, wherein said tools for driving in the stones comprise, on their lower face, a rib, for example a ring which abuts on the tables of the stones and which place them in the same plane parallel to said flat face of the setting when the cover is pressed by a press.

7. The device of claim 6, wherein said rib comprises, on its lower face, recesses which are disposed above the claws for setting the stones.

8. The device of claim 4 further comprising a vibrating bowl and a stone transfer tool, which transfer tool may be fixed inside said flange of said first cover and which vibrating bowl may be fixed to said transfer tool in order mechanically to position stones in housings which are machined in a jewel setting fixed inside said setting support.

9. The device of claim 8, wherein said vibrating bowl comprises a body which defines a closed central cavity which is connected to a suction apparatus and it comprises, on its upper face, a dish whose bottom descends towards the periphery from a central summit and housings each adapted to receive a stone, which are disposed on the periphery of the bottom of said dish and which communicate with said central cavity and the arrangement of said housings reproduces the arrangement on the setting of the housings adapted to receive said stones.

10. The device of claim 9, wherein the stone transfer tool defines an upwardly open cavity and comprises a ring which may penetrate in said dish and which is traversed by small bores which communicate with said cavity and said first cover comprises a conduit which opens out in an axial bore open at its lower end, which conduit is adapted to be connected on a suction apparatus to place the cavity of said transfer tool under reduced pressure when the latter is fixed to said first cover.

11. The device of claim 1, wherein said setting tools comprise on their lower face a setting rib which comes into abutment on the tops of the setting claws in order to deform them permanently when the cover is pressed down.

12. The device of claim 11, wherein the lower face of said setting rib comprises recesses which cover the tables of said stones and which avoid said setting rib from abutting said tables during setting of the claws.

13. The device of claim 11, wherein the lower face of the setting rib comprises concave notches which are positioned above the setting claws and which abut on the heads thereof.

14. The device of claim 13, wherein said concave notches have a depth increasing from the periphery towards the axis of the housing of a stone.

15. Process for mechanically setting a plurality of precious stones each having a table in a metallic jewel setting having a flat face, comprising the following steps of:

machining in said setting housings adapted to receive stones and claws adapted to be deformed by means of a numerical control machine, so that these housings present a deformable seat;

fixing said setting on a setting support which maintains it in a determined position;

placing said support in a well determined position in the bottom of a dish element which is placed on the lower plate of a press;

depositing a stone in each housing;

fixing on a cover a tool for driving the stones in their housing;

engaging said cover in said dish element, guiding it so that it remains well centered, and pressing on said cover with the second plate of the press until it comes into abutment against the upper face of said dish element and, at that moment, said tables of all the stones lie in the same determined plane parallel to said flat face of the setting;

then fixing on said cover a tool for setting said claws, engaging said cover again in said dish element and pressing again on said cover with the second plate of the press until it comes into abutment again against the upper face of said dish element and, at that moment, the claws are set uniformly on said stones.

16. The process of claim 15, wherein the stones are positioned simultaneously in said housings by mechanical means.

17. The process of claim 16 comprising the following steps:

first pouring said stones into a vibrating suction bowl having a dish and housing in the bottom of said dish, which housings reproduce the arrangement of the housing machined in said setting;

vibrating said bowl and placing it under a reduced pressure in communication with said housings so that said stones are mechanically distributed to and retained each in one of said housings;

positioning said bowl maintained under reduced pressure over a transfer tool comprising an axial cavity and small bores in air communication with said cavity, the arrangement of said bores corresponding to that of said bowl housings, which transfer tool is mounted on said cover;

placing said axial cavity under reduced pressure and cutting off suction in said vibrating bowl so that each of said stones adheres on one of said bores;

disposing said cover and said transfer tool while under reduced pressure in said dish above said jewel setting mounted on said setting support;

and eliminating the reduced pressure in said axial cavity of said transfer tool so that each stone is engaged in one of said housings of said jewel setting.

* * * * *